United States Patent [19]

Schulz

[11] Patent Number: 5,014,818

[45] Date of Patent: May 14, 1991

[54] CHILDREN'S VANITY STEP-STOOL

[76] Inventor: Kenneth Schulz, Scotts La., South Salem, N.Y. 10590

[21] Appl. No.: 568,755

[22] Filed: Aug. 17, 1990

[51] Int. Cl.[5] ..... A47B 46/00

[52] U.S. Cl. ..... 182/90; 182/35; 182/88; 182/228

[58] Field of Search ..... 182/90, 92, 88, 129, 182/21, 20, 35, 151, 228

[56] References Cited

U.S. PATENT DOCUMENTS

| | | | |
|---|---|---|---|
| 487,117 | 11/1892 | Farner | 182/35 |
| 2,881,040 | 4/1959 | Hartridge | 182/35 |
| 3,195,966 | 7/1965 | Doherty | 182/90 |
| 3,311,190 | 3/1967 | Naumann | 182/88 |
| 4,846,304 | 7/1989 | Rasmussen | 182/88 |

*Primary Examiner*—Reinaldo P. Machado

*Attorney, Agent, or Firm*—Abe Hatcher

[57] ABSTRACT

A step-stool for enabling a child to climb up to the top surface of a cabinet made of a top piece, a bottom piece and a middle step or platform piece adapted to slide out from between the top piece and the bottom piece to form a step. Two T-shaped spacers, one on each side, provide a channel for the middle platform piece to move outward and form the step. Screws, nails, or nuts and bolts act as fasteners to fit through the top piece, the two spacers and the bottom piece to hold them together, leave room for the middle slidable platform piece to be pulled out and to anchor the step-stool to a cabinet or other floor. The components of the step-stool of the invention may be marketed as a kit, put together to form an unanchored step-stool or anchored to a cabinet or other floor.

19 Claims, 2 Drawing Sheets

CHILDREN'S VANITY STEP-STOOL

BACKGROUND OF THE INVENTION

1. Field of the Invention

This invention relates to steps and stools. More particularly, it relates to a step-stool which enables a child to have access to a bathroom or kitchen counter or the like.

2. Description of the Prior Art

Bathroom and kitchen cabinets and vanities are built such that their counters and working surfaces are too high for small children to reach or play on. Presently available portable steps or platforms are dangerous, limited to special uses or too large for children to manipulate. For example, Kummerlin U.S. Pat. No. 4,421,206 describes a simple 3-step ladder with two legs connected with each other swingably around an axis in the region of an upper end of the legs. Hansen U.S. Pat. No. 4,664,227 has to do with a platform with an attachable handrail assembly for use with a recreation vehicle. Frazier et al U.S. Pat. No. 4,711,282 involves a portable 3-step collapsible stair having two inverted U-shaped cross members pivotally connected to one another. Tremblay U.S. Pat. No. 4,723,631 involves a foldable ladder designed to rest against a kitchen counter made of a rectangular main frame, spaced parallel rods interconnecting the two long side legs of the ladder and step panels each pivotally mounted at its front corners to one rod for pivotal action within the ladder frame. Nimz U.S. Pat. No. 4,844,199 discloses a device for helping a handicapped person move up and down a flight of stairs that includes upper and lower platforms and a handle to help stabilize the person using the device and also move it from step to step of the flight of stairs.

SUMMARY OF THE INVENTION

After extensive investigation, to satisfy this need for a way to allow a child to have safe access to a counter, I have devised a step-stool that fits into the space under a counter so that a middle-positioned platform thereof may be pulled out to step up on to reach the counter. In its broader aspects my invention involves, in ready to use, put together and installed form, three horizontal members, specifically, a top member, a middle member and a bottom member, preferably all of wood, the middle member being loosely placed between top and bottom members so that it will pull out to form a step, preferably as high off the floor as the floor of the kitchen or bathroom cabinet where installed, and two spacers, one on each side, looking at the step-stool from the front. In other words, the step-stool of the invention is made up generally of three layers, a fixed base, a fixed cover and a sliding shelf (which becomes a platform or step when pulled out) between the base and the cover.

In further detail, the step stool of the invention comprises a top shelf member, a middle sliding or slidable platform member adapted to be pulled out and used as a step when the step-stool is assembled, a bottom supporting member and two side-positioned T-shaped members I will also refer to hereinbelow as T's, the sliding platform member being adapted to rest on and slide along the top of the stem or upright portion of the T turned sideways, and the supporting member adapted to be in a fixed position underneath the sliding platform member. When these parts or components are assembled together with the top shelf member and bottom supporting member held in place by screws or nails or nuts and bolts or the like through the stem of the T, the sliding platform member is of a size to rest in a slidable manner beneath the top shelf member and on top of the bottom supporting member and be narrow enough, that is, not too wide to slide in and out between the bottoms of the stems or upright members of the T-shaped spacer members turned sideways and form a step. The step-stool of the invention may be fastened or anchored to the floor of a kitchen cabinet or bathroom vanity, or to the floor of a room. This construction means that the middle platform member should be narrower or of less width than the top and bottom members and of a width such that its sides don't quite touch the bottoms of the stems of the T-shaped spacer members on both sides and are slidable therealong.

To keep the slidable middle platform or step member from being pushed too far back or being pulled out entirely, a dowel or peg or knob my be employed fitting into a top member or bottom member groove or a groove or elongated opening in each so as to stop at either the ends of the groove or grooves. For convenience in grasping the middle member for pulling it out, a slot or elongated opening perpendicular in direction to that of the stopping groove or grooves, that is, extending from side to side partway in the middle member, may be furnished, in conjunction , if desired, with a quarter-moon or similar arc-shaped cut-away in the front end of the top member just above the perpendicular groove for ease of access to it.

When the step-stool of the invention is put together by fastening means, the top member is fixed in position by a plurality of nails, screws or nuts and bolts or the like extending through the stem of the T turned sideways and down into the bottom or supporting member, and on into the floor of the kitchen cabinet or the vanity when the step-stool is anchored in place.

BRIEF DESCRIPTION OF THE DRAWING

For a further understanding of the invention reference will now be made to the drawing which forms a part hereof.

DETAILED DESCRIPTION OF THE DRAWING AND OF A PREFERRED EMBODIMENT

Figure 1:
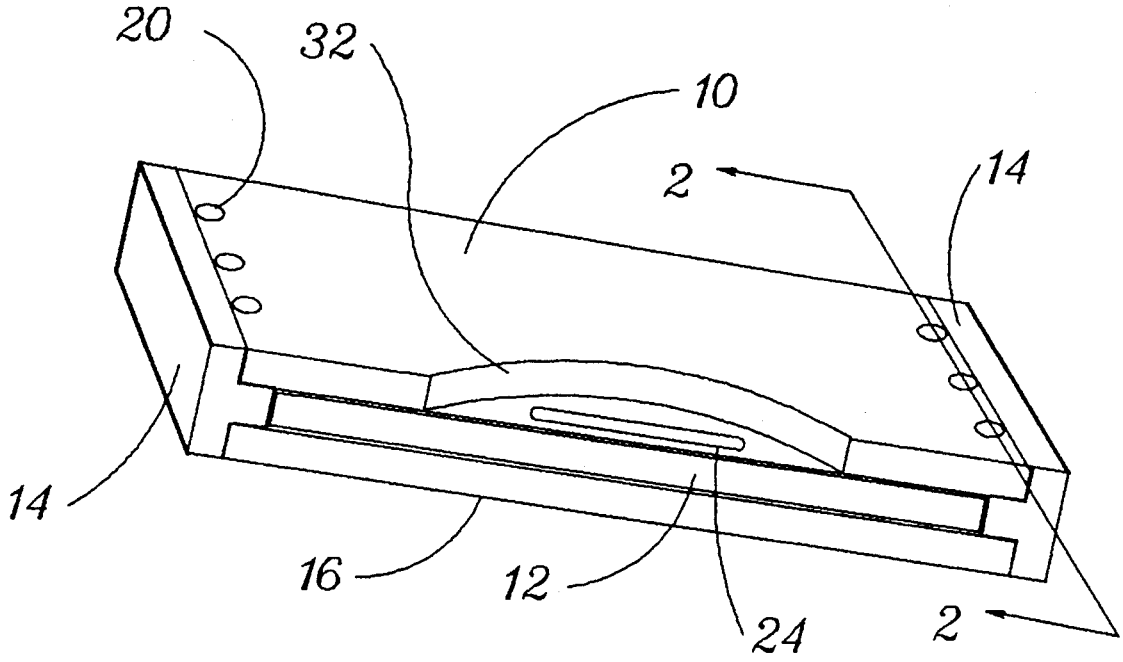
FIG. 1 is a perspective view of the step-stool of the invention showing the components thereof assembled together and ready to install in a kitchen or bathroom cabinet.
Figure 2:
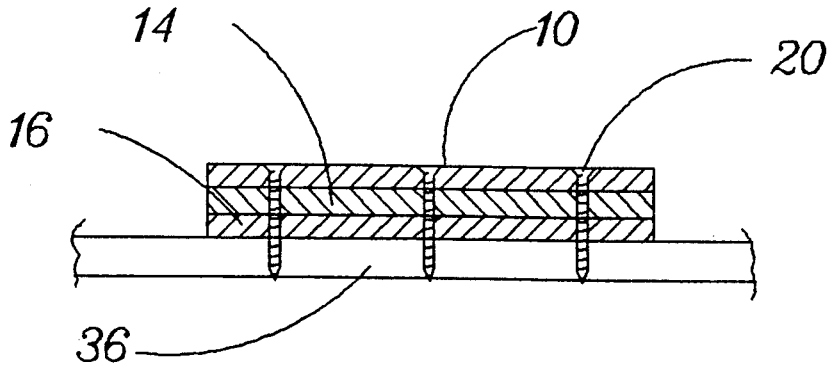
FIG. 2 is a cross section taken at 2—2 of FIG. 1 showing how the fastening means, such as screws, bolts (with nuts under the cabinet floor or room floor), nails or the like (here screws) fit through the top piece, the ledge formed by the stem, arm or upright portion of the T (better shown in FIGS. 1 and 3) and the bottom piece of the step-stool, and into the floor or bottom of a cabinet, leaving the middle or step piece free to be pulled out so that a child can step on it and reach the top surface of a cabinet.
Figure 3:
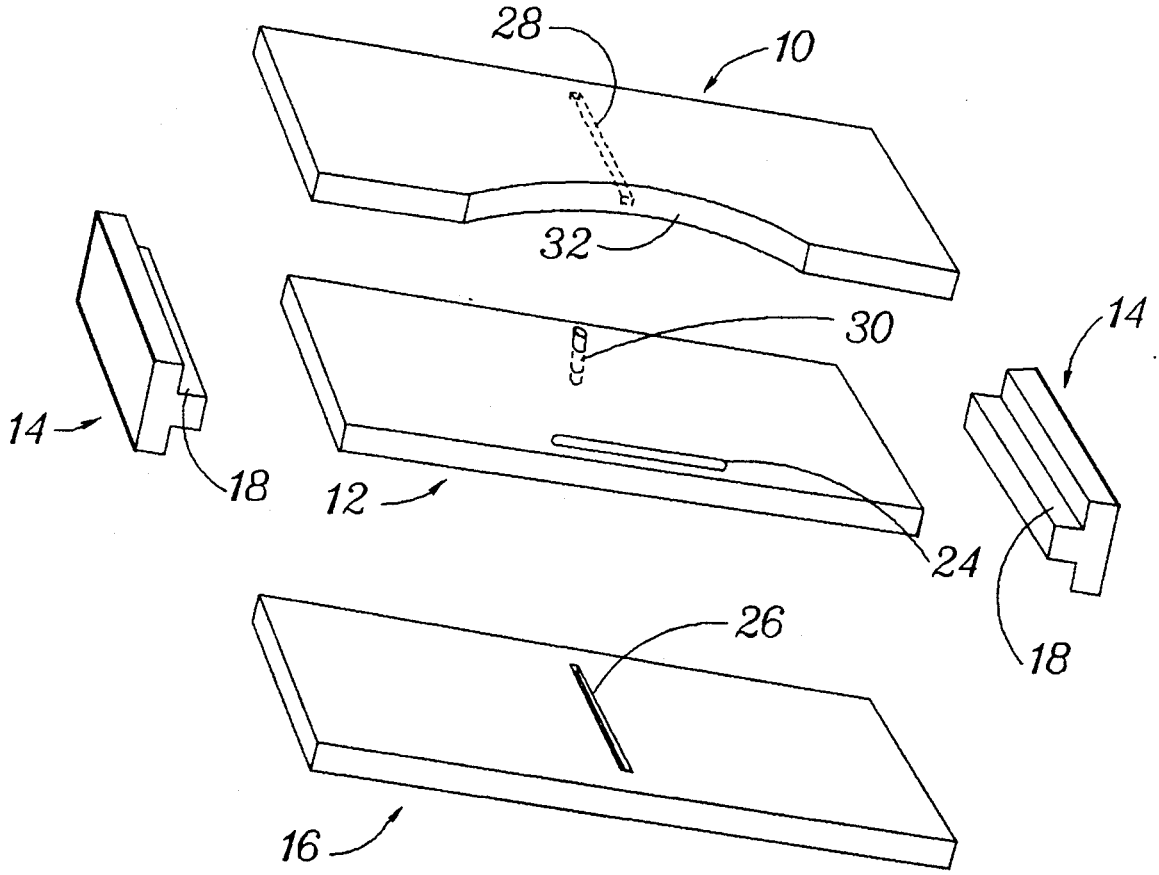
FIG. 3 is a perspective view of the parts or components of the step stool or of a kit for the parts or components (except for the fastening screws or the like, which are shown in FIGS. 1 and 2), ready for assembly and installation.

In the drawing, top shelf member 10 rests at both sides on ledges 18 formed by the arms or stems of T-shaped spacer members 14, the bottoms of the stems of the T-shaped spacers turned sideways almost touching the sides (when looking from the front as at FIG. 1) of sliding platform member 12, leaving just enough room for the sliding or slidable platforms member 12 to be pulled out to form a step. Middle sliding platform member 12 is also slightly less thick than the thickness of the aforesaid bottoms of the sideways T's to aid in its slidability between top member 10 and bottom support member 16. A dowel, peg or stop 30 may slide along with middle sliding platform member 12 in a groove or elongated opening 26 in bottom supporting member 16 and/or in a groove or elongated opening 28 in top shelf member 26 until it comes to the end of the groove or grooves. When the step-stool of the invention is installed on a floor of a cabinet or floor of a room 36, as shown in FIG. 2, screws 20 or the like extend all the way through top shelf member 10, ledges 18 of spacers 14, bottom supporting member 16 and on into regular floor or cabinet floor 36 to attach the step-stool securely. To aid in pulling out platform or step 12 a cut-back 32 in the front end of top shelf member 10 exposing a pull-out slot or extended opening 24 in middle platform member 12 may be used, if desired. Top member 10, middle slidable platform member 12 and bottom supporting member 16 are all substantially rectangular except for when the aforesaid cut-back 32 in top shelf member 10 shown in FIGS. 1 and 3 is used. Sliding platform member 12, because of fitting close to the bottom of both sideways T-shaped spacer members, is necessarily of less width (from left to right looking at FIGS. 1 and 3 from the front) than top shelf member 10 and bottom supporting member 16.

While the invention has been described in terms of certain preferred embodiments, the claims appended hereto are intended to encompass all embodiments of the invention.

Having thus described my invention and certain preferred embodiments thereof, I claim:

1. Step stool apparatus comprising, in cooperating constructable combination and adapted to be put together as a pull-out cabinet step, (1) a rectangular top shelf member, (2) a rectangular bottom supporting member of substantially the same width from side to side as said top shelf member, (3) a slidable middle platform member of less width from side to side than said top shelf member and said bottom supporting member and adapted to be slidably positioned below said top shelf member and above said bottom supporting member so as to form a step when pulled out along part of the length from back to front of said top shelf member and said bottom supporting member, (4) two T-shaped spacer members when turned sideways having stems adapted to form ledges, one along one side of said slidable middle platform member and one along the other for supporting said top shelf member, whereby said middle platform member may slide inward and outward along part of the lengths of said bottoms of said stems of said T-shaped spacer members between said top shelf member and said bottom supporting member, said bottom supporting member being adapted to fit under said ledges on each side, and (5) fasteners for assembling said members together as a step-stool and attaching them securely to a floor whereby said slidable middle platform member when pulled partway out becomes a step which will hold up the weight of a child.

2. The step-stool apparatus of claim 1 wherein said fasteners comprise a plurality of screws long enough to fit through said top shelf member, said T-shaped spacer members and said bottom supporting member and into a subjacent floor.

3. The step-stool apparatus of claim 1 wherein said fasteners comprise a plurality of nuts and bolts.

4. The step-stool apparatus of claim 1 forming a kit.

5. A kit comprising as separate components thereof adapted to be put together and installed as a working step-stool (1) a rectangular top shelf member, (2) a rectangular bottom supporting member of substantially the same width from side to side as said top shelf member, (3) a slidable middle platform member of less width from side to side than said top shelf member and said bottom supporting member and adapted to be slidably positioned below said top shelf member and above said bottom supporting member so as to form a step when pulled out along part of the length from back to front of said top shelf member and said bottom supporting member, (4) two T-shaped members when turned sideways having stems adapted to form ledges, one along one side of said slidable middle platform member and one along the other for supporting said top shelf member, whereby said middle platform member may slide inward and outward along part of the lengths of bottoms of stems of said T-shaped spacer members between said top shelf member and said bottom supporting member, said bottom supporting member being adapted to fit under said ledges on each side, and (5) fasteners for assembling said members together as a step-stool and attaching them securely to a floor whereby said slidable middle platform member when pulled partway out becomes a step which will hold up the weight of a child.

6. The kit of claim 5 wherein said fasteners comprise a plurality of screws long enough to fit through said top shelf member, said T-shaped spacer members and said bottom supporting member and into a subjacent floor.

7. The kit of claim 5 wherein said fasteners comprise a plurality of nuts and bolts.

8. The apparatus of claim 1 wherein said top member has a groove along part of its length from front toward back, said bottom member has a groove along part of its length from front toward back and said middle platform member has a dowel partway along its length from front toward back positioned so as to slide along said grooves.

9. The apparatus of claim 1 wherein said top member has a groove along part of its length from front toward back and said middle platform member has a dowel partway along its length from front toward back positioned so as to slide along said grooves.

10. The apparatus of claim 1 wherein said bottom supporting member has a groove along part of its length from front toward back and said middle platform member has a dowel partway along its length from front toward back adapted to fit in said groove when said apparatus is put together as a step-stool.

11. The apparatus of claim 1 wherein said top member has a cut-out portion at a front end thereof and said middle member has a side-toward-side notch therein, whereby said middle shelf member may be pulled partway out when said apparatus is assembled as a step-stool and also when it is installed on the floor of a cabinet.

12. A step-stool comprising a rectangular top shelf member, a rectangular bottom supporting member of the same width from side to side as said top member, a slidable middle platform member of less width than said top shelf member and said bottom supporting member slidably positioned below said top shelf member and said bottom supporting member and adapted to form a step when pulled out along part of the length from back to front of said top shelf member and said bottom supporting member, and two spacer members in the shape of a T turned sideways with each having the bottom of a stem thereof not quite touching a side of said middle platform member, said top shelf member resting on two ledges formed by the stems of the T's and said bottom supporting member fitting under each ledge and under said middle platform member, and a plurality of fasteners fitting along each edge of said top shelf member through said top shelf member, said two ledges and said bottom supporting member.

13. The step-stool of claim 12 wherein said plurality of fasteners comprises screws.

14. The step-stool of claim 12 wherein said plurality of fasteners comprises nuts and bolts.

15. The step-stool of claim 12 installed on a cabinet floor underneath a cabinet counter and having said plurality of fasteners holding said step-stool firmly in place by extending into said cabinet floor.

16. The step-stool of claim 12 wherein said middle slidable platform member has a dowel thereon and a groove for it to slide along in said bottom supporting member.

17. The step-stool of claim 12 wherein said middle slidable platform member has a dowel thereon with a groove for it to slide along in said top shelf member.

18. The step-stool of claim 12 wherein said middle slidable platform member has a dowel thereon with grooves for it to slide along in said bottom supporting member and in said top shelf member.

19. The step-stool of claim 12 wherein said top shelf member has a cutaway at the front end thereof which reveals a crosswise slot in said middle slidable platform member whereby it may be pulled out partway along bottoms of T's turned sideways on each side.

* * * * *